US007970526B2

(12) United States Patent
Ibrahim

(10) Patent No.: US 7,970,526 B2
(45) Date of Patent: Jun. 28, 2011

(54) INTENSIFIER QUILL FOR FUEL INJECTOR AND FUEL SYSTEM USING SAME

(75) Inventor: Dan Ibrahim, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 350 days.

(21) Appl. No.: 12/319,250

(22) Filed: Jan. 5, 2009

(65) Prior Publication Data

US 2010/0174467 A1 Jul. 8, 2010

(51) Int. Cl.
*F02D 41/30* (2006.01)
*F02M 37/04* (2006.01)

(52) U.S. Cl. ..... 701/103

(58) Field of Classification Search ..... 701/103–105; 123/457, 458, 478, 480; 73/114.45, 114.38
See application file for complete search history.

(56) References Cited

U.S. PATENT DOCUMENTS 4,440,132 A 4/1984 Terada et al.
4,603,671 A 8/1986 Yoshinaga et al.
5,413,076 A 5/1995 Koenigswieser et al.
5,622,152 A 4/1997 Ishida
6,418,913 B1 * 7/2002 Schmidt et al. ..... 73/114.45
6,439,202 B1 8/2002 Carroll, III et al.
6,453,875 B1 9/2002 Mahr et al.
6,575,137 B2 * 6/2003 Hefler et al. ..... 123/446
6,637,408 B2 10/2003 Djordjevic
6,928,984 B1 8/2005 Shamine et al.
6,951,204 B2 10/2005 Shafer et al.
7,131,427 B2 11/2006 Kawasaki et al.
7,252,070 B2 8/2007 Magel
7,383,817 B2 6/2008 Horiuchi et al.
2002/0129792 A1 9/2002 Rodriguez-Amaya et al.
2004/0055562 A1 3/2004 Stewart et al.
2004/0159716 A1 8/2004 Azam et al.
2004/0163626 A1 8/2004 Stockner et al.
2004/0168673 A1 9/2004 Shinogle
2004/0195385 A1 10/2004 Lawrence et al.
2005/0028788 A1 2/2005 Shafter et al.
2005/0098144 A1 5/2005 Stewart et al.

* cited by examiner

*Primary Examiner* — Hieu T Vo
(74) *Attorney, Agent, or Firm* — Liell & McNeil

(57) ABSTRACT

An intensifier quill for a fuel injector fluidly connects a fuel injector to a common rail. The intensifier quill selectively supplies fuel to the fuel injector at either an intensified pressure or un-intensified common rail pressure. Fuel supplied by the quill at both the intensified and un-intensified pressure passes through a quill body, which includes an actuation chamber, a control chamber and a pressurization chamber. Energizing an actuator of the quill allows fuel from the control chamber to flow to drain, increasing pressure inside the pressurization chamber and the fuel injector to intensified pressure. Upon energizing the actuator of the fuel injector, fuel injector injects fuel at the intensified pressure. When the quill's actuator is de-energized and the fuel injector's actuator is energized, fuel injector injects fuel at the un-intensified pressure.

20 Claims, 5 Drawing Sheets

INTENSIFIER QUILL FOR FUEL INJECTOR AND FUEL SYSTEM USING SAME

TECHNICAL FIELD

The present disclosure generally relates to Common Rail Fuel Systems and in particular to pressure intensified systems using a separate intensifier quill fluidly connected to individual fuel injectors.

BACKGROUND

Many diesel engines utilize a common rail fuel system where a common rail supplies high-pressure fuel to associated fuel injectors via branch passages that typically extend through the engine head. These branch passages typically include a specialized pipe, which is often referred to as a quill. The quill may include a rounded end received by a conical seat of the high-pressure fuel inlet port of the fuel injector and another high-pressure fitting connection or seat at its opposite end to connect to the common rail.

At present, due in part to the ever increasingly stringent emissions standards, manufacturers of fuel injectors are trying to design and manufacture engines with lower emissions than before. One way to reduce emissions produced by engines is by operating fuel injectors at higher pressures. Due to the increased costs associated with operating at higher pressures, manufacturers of fuel injectors find it troublesome to produce streamlined fuel systems that can easily be modified to operate at higher injection pressures if required. Furthermore, manufacturers may find it problematic to replace the older fuel systems with these newer fuel systems inside the engine without major modifications to the engine.

There have been attempts in the past to operate fuel injectors at higher pressures. One way to operate at higher pressures is to use an intensified fuel injection pressure. U.S. Pat. No. 3,453,875 by Mahr describes a fuel injection system that uses a pressure step-up unit. In the Mahr reference, the fuel injector includes a pressure step-up unit that allows for injection of fuel at either the common rail pressure or at an intensified pressure. The Mahr reference contemplates the possibility of a pressure intensifier unit outside the fuel injector, but does not show or suggest where or how an external intensifier could be incorporated into its system.

Engine manufacturers may have customers in different jurisdictions that have different emission standards. The cost of manufacturing engines may be kept low by manufacturing engines with as many common engine parts as possible, including parts associated with the fuel system. However, being able to manufacture engines that may meet the emission standards of different jurisdictions while using as many common engine parts as possible to keep manufacturing costs low may also be problematic.

The present disclosure is directed to overcoming one or more of the problems set forth above.

SUMMARY

In one aspect, an engine includes an engine head and a fuel injector mounted in the engine head. A quill is partially positioned in the engine head, and has a first end receiving fuel from outside the engine head and a second head in seated contact with an inlet port of the fuel injector. The quill further includes a quill body. An intensifier piston is slidably movable within the quill body. An electrical actuator is coupled to a control valve.

In another aspect, a method of operating an engine, including an engine head and a quill disposed within the engine head and in seated contact with a fuel injector, comprises the steps of injecting fuel from a fuel injector at an intensified pressure by moving an intensifier piston of the quill. The method also includes a step of injecting fuel from the fuel injector at an un-intensified pressure by moving common rail fuel into the fuel injector from a common rail through the quill.

In another aspect, a quill for a common rail fuel system includes a quill body defining an inlet port and an outlet port. An electrical actuator is coupled to a control valve fluidly connected to the quill body. An intensifier piston is slidably movable inside the quill body and a passageway that is at least partially defined by the quill body, fluidly connects the inlet port to the outlet port.

DETAILED DESCRIPTION

A typical common rail fuel injector is supplied fuel from a common rail at about rail pressure using a quill and has injection pressures that may be about equal to the rail pressure supplied to the fuel injector. Those skilled in the art may appreciate that increasing the pressure at which fuel is supplied to the fuel injector results in an increase in injection pressure, which may improve combustion efficiency and may reduce the production of undesirable emissions, such as NOx. The present disclosure relates to an intensifier quill, which includes an intensifier piston that may supply fuel to the fuel injector at either an intensified pressure, which is a pressure greater than the rail pressure or an un-intensified pressure, which is about rail pressure.

Figure 1:
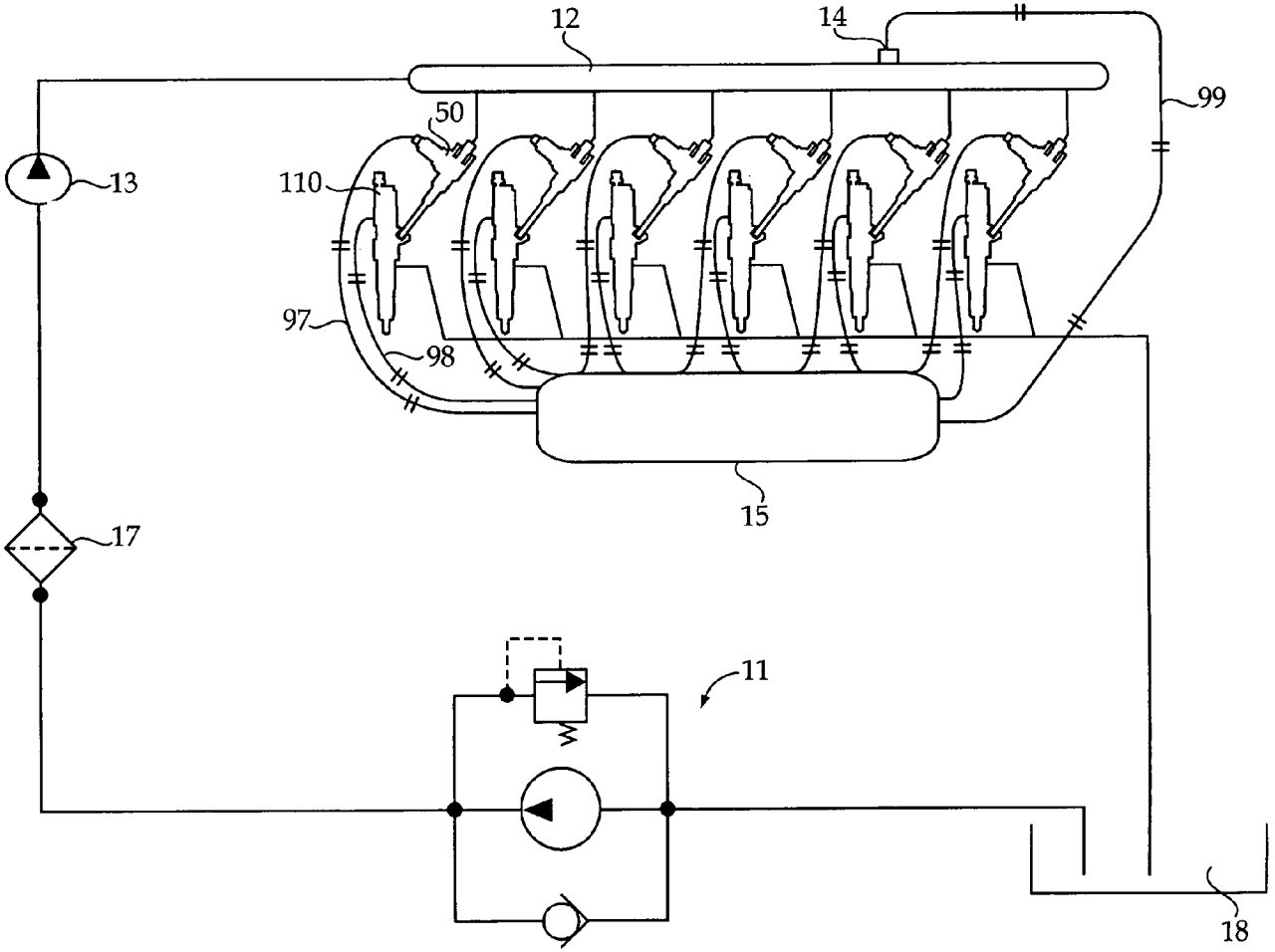
FIG. 1 is a schematic view of a common rail fuel system according to the present disclosure.

Referring to FIG. 1, a fuel system 10 includes a common rail 12, an electronic controller 15, a fuel tank 18 and a plurality of fuel injectors 110. Those skilled in the art may appreciate that the plurality of fuel injectors operate identically, therefore describing one of the plurality of fuel injectors is sufficient to understand how other fuel injectors in the fuel system may operate. Fuel from the fuel tank 18 is supplied to the common rail 12 via a fuel transfer pump 11 that maintains a pressure difference between the fuel tank 18 and the pressure in the common rail 12. Fuel then passes through a filter 17 that removes particles that may clog the nozzles of the fuel injectors 110. A high pressure pump 13 raises the pressure of the fuel at the common rail 12 to rail pressure. A pressure sensor 14 communicates pressure information inside the common rail 12 to the electronic controller 15 via pressure communication link 99. The fuel injector 110 is fluidly connected to a quill 50, which fluidly connects the fuel injector 110 to the common rail 12. A first communication link 97 connects the electronic controller 15 to the quill 50, while a second communication link 98 connects the electronic controller 15 to the fuel injector 110.

Figure 2:
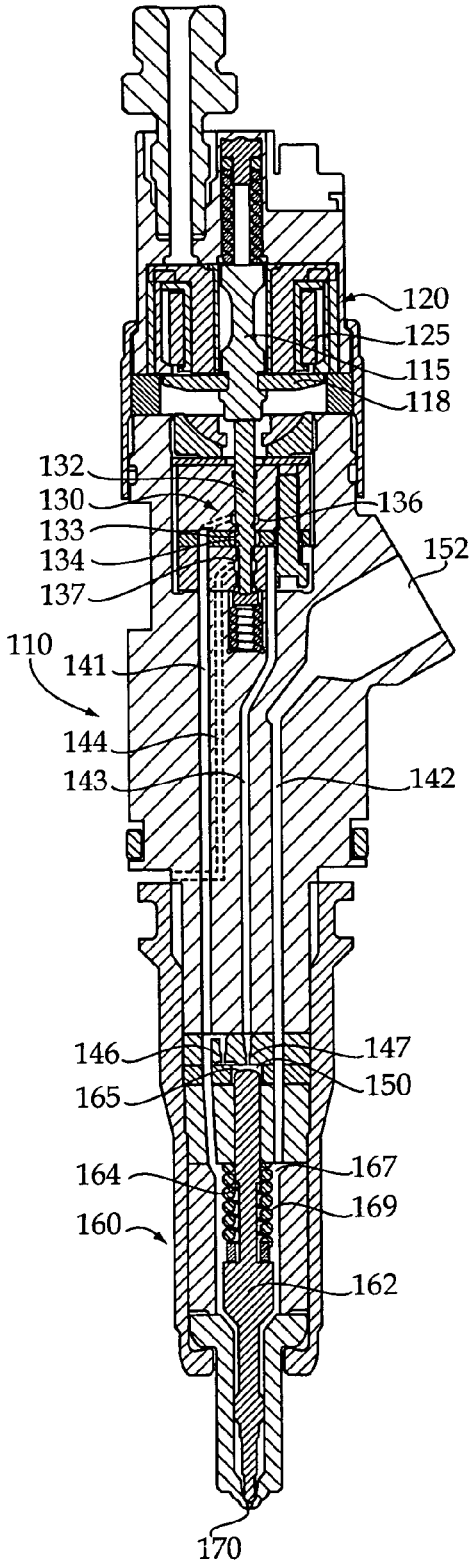
FIG. 2 is an sectioned view of one of the fuel injectors shown in FIG. 1.

Referring to FIG. 2, one of the common rail fuel injectors 110 of FIG. 1 is shown. The fuel injector 110 includes an armature assembly 115 having an armature 118, movable between a first and second armature position and a solenoid assembly 120 that includes a solenoid coil 125 that is either in an energized state or a de-energized state. A control valve assembly 130 includes a control valve member 132, which is operatively coupled to the armature 118 and moves between an upper valve seat 133 and a lower valve seat 134. The fuel injector 110 further includes a needle check valve 162 disposed inside a nozzle assembly 160 and biased by a nozzle spring 169 to a closed configuration. The control valve member 132 controls the motion of the needle check valve 162 between an open and the closed configuration by controlling the flow of fuel that passes through the area between the upper valve seat 133 and the lower valve seat 134.

The needle check valve 162 in turn, controls the flow of fuel passing through nozzle outlets 170. The needle check valve 162 has an opening hydraulic surface 164 exposed to fluid pressure inside a nozzle chamber 167, and a closing hydraulic surface 165 exposed to fluid pressure inside a needle control chamber 150. The nozzle chamber 167 may receive fuel entering the fuel injector 110 from a rail inlet port 152 via a rail supply passage 142. In the present disclosure, the nozzle chamber 167 may be fluidly connected to a common rail via a predecessor quill (See 90 in FIG. 3) or an intensifier quill (See 50 in FIG. 4), thereby maintaining rail pressure inside the nozzle chamber 167.

A valve supply passage 141 establishes a fluid connection between the nozzle chamber 167 and the control valve assembly 130. The valve supply passage 141 also fluidly connects the nozzle chamber 167 to the needle control chamber 150 via a first flow restrictor 146. A second flow restrictor 147, having a larger flow area than the flow area of the first flow restrictor 146, fluidly connects the needle control chamber 150 to either high-pressure fuel or to a low-pressure fuel drain passage 144 via the control valve assembly 130. The drain passage 144 is shown in dotted lines because the drain passage lies in a plane not depicted in the section view shown in FIG. 1. Furthermore, the needle control chamber 150 remains fluidly connected to the nozzle chamber 167 via the first flow restrictor 146 regardless of the position of the control valve member 132.

When the solenoid assembly 120 is in a de-energized state, the armature assembly 115 is at a first armature position and the control valve member 132 is at the lower valve seat 134. A first annular opening 136 fluidly connects the high-pressure fuel from the nozzle chamber 167 to the needle control chamber 150 via the second flow restrictor 147 thereby increasing the pressure acting on the closing hydraulic surface 165 inside the needle control chamber 150 to rail pressure. The nozzle assembly 160 and the needle check valve 162 are in a closed configuration when the pressure acting on the closing hydraulic surface 165 is high enough to keep the needle check valve 162 in sealed contact with the nozzle tip 170. This allows the needle check valve 162 to fluidly block the fuel inside the nozzle chamber 167 from leaving the nozzle outlets 170.

Upon energizing the solenoid assembly 120, the armature assembly 115 moves to a second armature position and the control valve member 132 moves to the upper valve seat 133. When the control valve member 132 is moved to the upper valve seat 133, the second flow restrictor 147 fluidly connects the needle control chamber 150 to a low-pressure drain passage 144 via a second annular opening 137 and the pressure communication passage 143, thereby relieving pressure inside the needle control chamber 150. The nozzle assembly 160 and the needle check valve 162 are in an open configuration when the pressure acting on the closing hydraulic surface 165 is reduced enough to move the needle check valve 162 out of sealed contact with the nozzle tip 170. This allows the fuel inside the nozzle chamber 167 to pass through the nozzle tip 170 to outside the fuel injector 110.

According to the present disclosure, fuel from the common rail 12 moves to the nozzle chamber 167 of the fuel injector 110 and from there, into other passages inside the fuel injector 110. While the solenoid assembly 120 of the fuel injector 110 is de-energized, the nozzle outlets 170 are closed and fuel entering the fuel injector 110 from the common rail 12 may be kept at rail pressure. When the fuel injector 110 is energized to move the needle check valve 162 to an open configuration, allowing fuel inside the nozzle chamber 167 to flow through the nozzle outlets 170, the fuel flowing through the nozzle outlets 170 has an injection pressure equal to the pressure at which fuel is entering the fuel injector 110 through the rail inlet port 152. Therefore, the higher the pressure of the fuel entering the fuel injector 110 through the rail inlet port 152, the higher the injection pressure of the fuel leaving the fuel injector 110 through the nozzle outlets 170.

Figure 3:
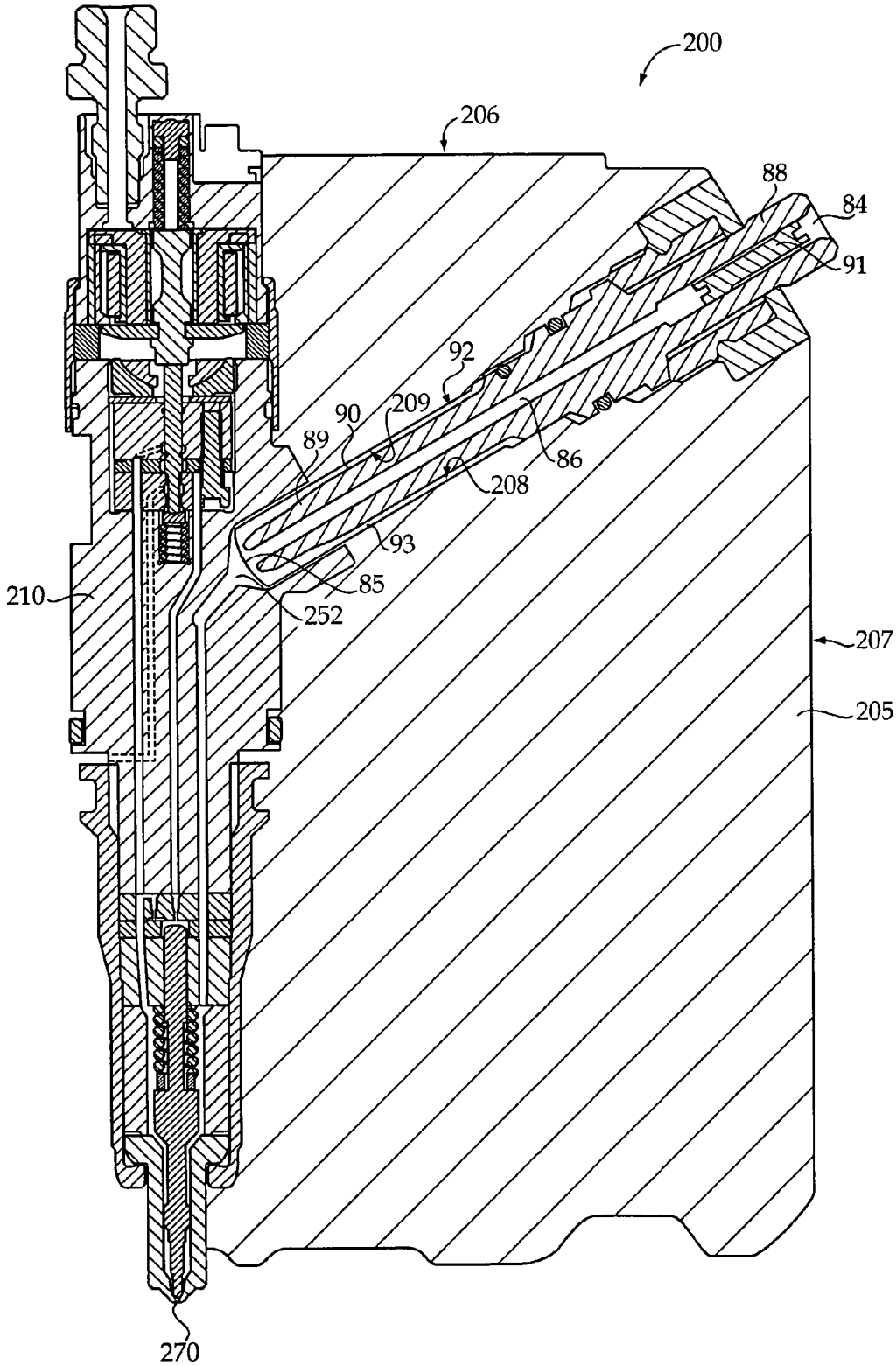
FIG. 3 is a sectioned view of an engine including a conventional quill disposed within an engine head according to one embodiment of the present disclosure.
Figure 4:
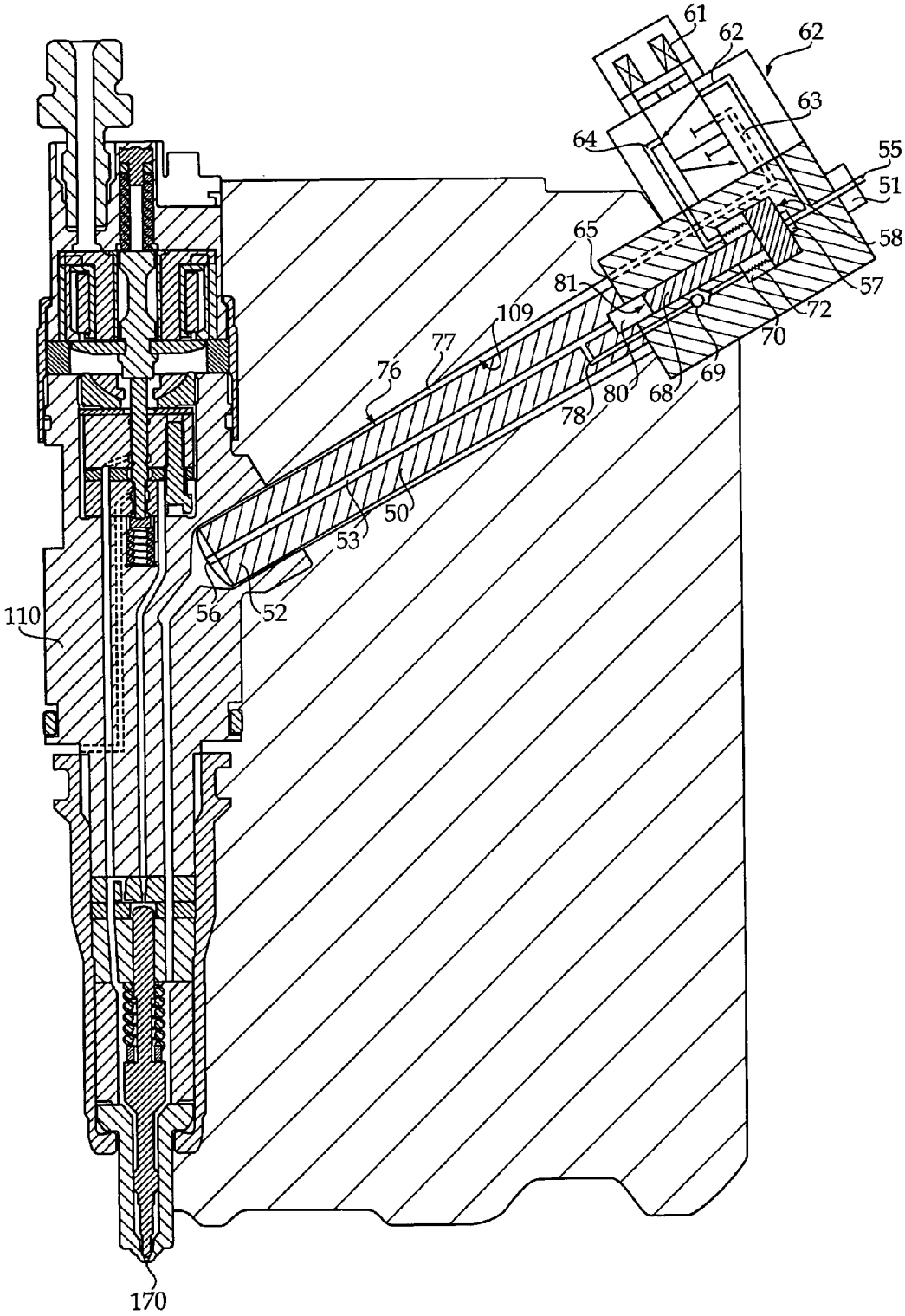
FIG. 4 is a sectioned view of the engine shown in FIG. 3, except including an intensifier quill disposed within the engine head, and fluidly connected to a fuel injector of the common rail fuel system according to the embodiment shown in FIG. 1.

FIG. 3 shows an engine 200, which includes an engine head 205. A predecessor fuel injection system includes a predecessor fuel injector 110 that is mounted on a top 206 of the engine head 205. FIG. 4 shows a nearly identical engine 200, that also includes fuel injector 110 also mounted on a top 106 of an engine head 105. The present disclosure teaches an intensifier quill that is designed to work with fuel injectors 110. Thus, an engine manufacturer could offer two versions of nearly identical engines, one with a conventional quill and another with an intensifier quill.

Referring to FIG. 3, the fuel injection system further includes a predecessor quill 90 partially positioned inside a bore 208 defined by an inner wall 209 inside the engine head 205, and extending out through a side 207 of the engine head 205. The quill 90 shown in FIG. 3 does not include an intensifier mechanism and therefore, is unable to supply fuel to the fuel injector 210 at pressures higher than the rail pressure. The quill 90 includes a first end 88 having an inlet port 84 that may be fluidly connected to the common rail 12, and a second end 89 having an outlet port 85. The second end 89 may be in seated contact with the rail inlet port 252 of the fuel injector 210. In one embodiment, the second end 89 may be spherical and may sit in a conical shaped rail inlet port 252 of the fuel injector 210. The quill 90 further includes a passageway 86 extending from the inlet port 84 to the outlet port 85 of the quill 90. An edge filter 91 sits along the passageway 86 filtering the fuel passing through the passageway 86 before the fuel enters the fuel injector 210. A drain channel 93 extends between outer surface 92 of the quill 90 and the inner wall surface 209 of the engine head 205. The drain channel 93 may be fluidly connected to the fuel tank 18, where fuel that may leak into the drain channel 93 is sent back to the fuel tank 18 and re-circulated to the common rail 12.

Figure 5:
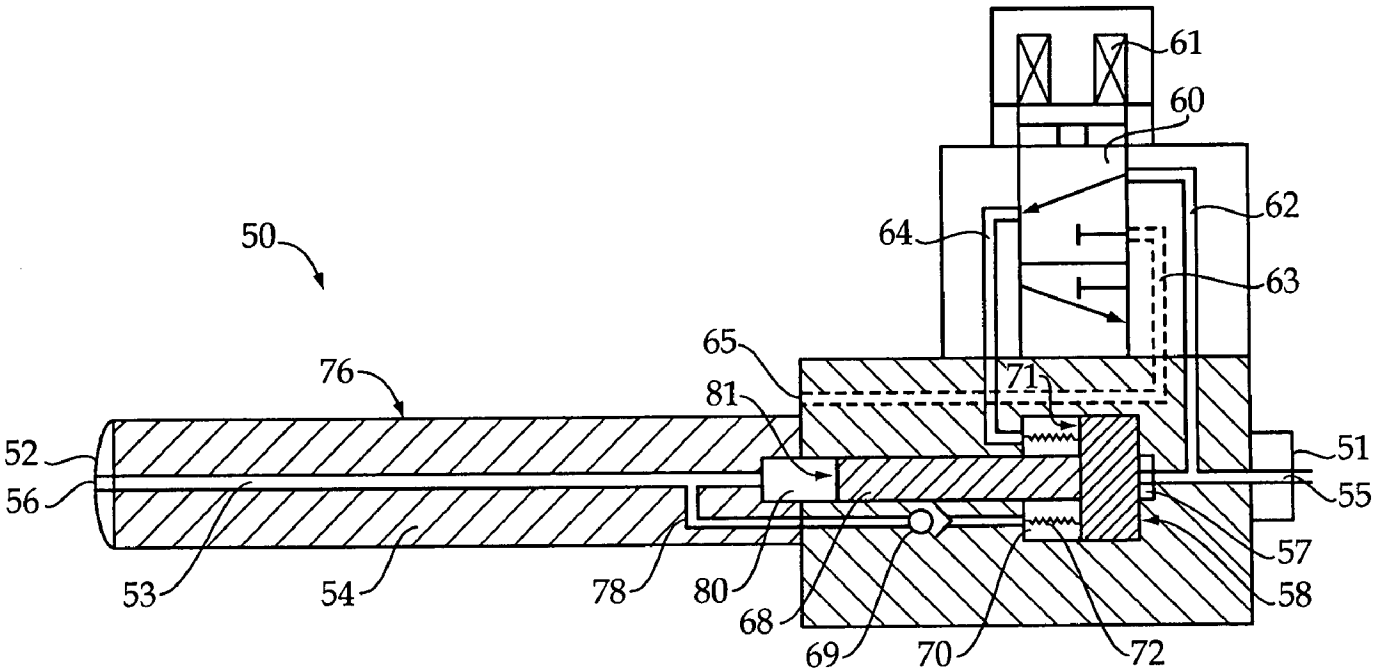
FIG. 5 is a partially sectioned, schematic view of the intensifier quill according to the present disclosure.

FIGS. 4 and 5 refer to an intensifier quill 50 that is capable of supplying fuel to the fuel injector 110 at various pressures, including rail pressure and pressures greater than the rail pressure.

Referring first to FIG. 4, FIG. 4 shows an engine 110 that includes an engine head 105 that is identical or similar to the engine head 205 of the predecessor engine 200. The fuel injection system 10 includes the fuel injector 110 mounted on a top 106 of the engine head 105 and the intensifier quill 50 partially positioned inside a bore 108 defined by an inner wall surface 109 inside the engine head 105, and extending out through a side 107 of the engine head 105. The quill has an outer surface 76 that along with the inner wall 109 of the engine head 105, partially defines a drain channel 77 that is fluidly connected to the fuel tank 18 via a passage not shown. The arrangement shown in FIG. 4 may be identical to predecessor fuel injection systems arrangements, such as the arrangement shown in FIG. 3, providing manufacturers the flexibility of assembling either the predecessor fuel injection system or the present fuel injection system 10, on the same engine with no or slight modifications. In one embodiment, the shape and size of the bore 208 of a predecessor engine head 205 may be modified to accommodate the intensifier quill 50. In one embodiment, engine 100 and engine 200 are identical, except that engine 200 includes conventional quill 90 and engine 100 includes the intensified quill 50.

The fuel injector 110 and the intensifier quill 50 may be clamped to the top 206 and side 207 of the engine head 105, respectively, to inhibit any leakage that may occur during operations at high-pressures. In addition, one of the quill 50 or the fuel injector 110 has a spherical end and the other has a conical seat to engage the quill 50 and the fuel injector 110 in a sealed relationship. In one embodiment, the quill 50 has a spherical end 52 that is snugly fit into the conical seat surrounding the rail inlet port 152 of the fuel injector 110.

Referring also to FIG. 5, the quill 50 has a first end 51 that may receive fuel from a common rail located outside the engine head 105 and a second end 52 in seated contact with the fuel injector 110. The quill 50 includes a quill body 54 that defines an inlet port 55, and an outlet port 56 having a spherical end, fluidly connected to the rail inlet port 152 of the fuel injector 110. The quill body 54 also includes an actuation chamber 57, a control chamber 70 and a pressurization chamber 80. Further, the quill body 54 partially defines a passageway 53 that extends between the inlet port 55 and the outlet port 56, and fluidly connects the common rail 12 to the fuel injector 110. The passageway 53 includes various smaller passages, such as a high-pressure passage 62, a communication passage 64 and a fluid connection passage 78.

The quill 50 also includes an electrical actuator 61 coupled to a control valve 60. The electrical actuator 61 receives control signals from the engine controller 15 shown in FIG. 1, such that the electrical actuator 61 may control the movement of the control valve 60 between a first valve position and a second valve position, which in turn controls the pressure inside the control chamber 70 via the communication passage 64.

When the electrical actuator 61 coupled to the control valve 60 is energized, the control valve is in the second valve position, fluidly connecting the control chamber 70 to the low-pressure drain port 65, such that fuel in the control chamber 70 moves to the drain passage via communication passage 64 and the control valve 60. In this position, fuel inside the control chamber 70 moves towards the drain port 65 until there is no fuel in the control chamber 70 or the control valve 60 moves to the first valve position.

When the electrical actuator 61 coupled to the control valve 60 is de-energized, the control valve 60 moves towards the first valve position fluidly connecting the control chamber 70 to the common rail 12 via high-pressure passage 62. In this position, fuel from the common rail 12 moves towards the control chamber 70 via the control valve 60 until either the pressure in the control chamber 70 is at rail pressure, or the control valve 60 moves to the second valve position.

The quill 50 further includes an intensifier piston 68 slidably movable within the quill body 54. The intensifier piston 68 of the quill 50 includes a large surface 58 exposed to fluid pressure inside the actuation chamber 57, a control surface 71 exposed to fluid pressure inside the control chamber 70 and a small surface 81 exposed to fluid pressure inside the pressurization chamber 80, respectively. A fluid connection passage 78, partially defining the passageway 53, fluidly connects the control chamber 70 to the pressurization chamber 80 via a check valve 69, such that fluid may flow from the control chamber 70 to the pressurization chamber 80 but not vice versa. The check valve 78 remains open as long as the pressure inside the control chamber 70 is not smaller than the pressure inside the pressurization chamber 80. In an alternative embodiment, the fluid connection passage 78 and the check valve 69 may partially be defined within the intensifier piston 22.

The intensifier piston 68 moves between a first piston position, which is a retracted (as shown), un-intensified position and a second piston position, which is a compressed, intensified position depending upon the forces acting upon the large surface 57, control surface 71 and small surface 81 of the intensifier piston 68. When the net force acting on the small surface 81 and control surface 71 is greater than the net force acting on the large surface 58, the intensifier piston 68 moves to or maintains the first piston position. When the net force acting on the small surface 81 and control surface 71 is less than the net force acting on the large surface 58, the intensifier piston 68 moves to or maintains the second piston position.

The actuation chamber 57 is fluidly connected to the common rail 12 via the inlet port 55 of the quill 50. Fuel from the common rail 12 occupies the actuation chamber 57 at rail pressure, exposing the large surface 58 of the intensifier piston 68 to rail pressure, thereby exerting a force on the large surface 58 towards the second piston position that is equivalent to the product of rail pressure and the surface area of the large surface 58 of intensifier piston 68.

The control chamber 70 may be fluidly connected to the common rail 12 or the low-pressure drain port 65. Fuel occupying the control chamber 70 exerts a force on the control surface 71 of the intensifier piston 68 towards the first piston position. The magnitude of the force exerted by fuel inside the control chamber 70 is the product of fluid pressure and the surface area of the control surface. The control chamber 70 also includes a biasing spring 72, which exerts a biasing force on the control surface 71 of the intensifier piston 68 towards the first piston position.

Fuel inside the pressurization chamber 80, the control chamber 70 and the actuation chamber 57 are hydraulically balanced when the small surface 81, the control surface 71 and the large surface 58 are exposed to rail pressure. Those skilled in the art may appreciate selecting a biasing spring 72 that has a sufficient preload to retract the intensifier piston 68 between injection events. The time it takes to retract the intensifier piston depends on the preload of the biasing spring 72. Those skilled in the art may further appreciate that by adjusting the size of the pressurization chamber 80, the size of the surface areas of the large, control and small surfaces, 58, 71 and 81, and the spring preload of the biasing spring 72, operators may achieve their desired injection pressures and quantities. Additionally, the pressurization chamber 80 should be made big enough so that the amount of fuel that can be stored inside the pressurization chamber 80 is more than the desired maximum intensified pressure injection quantity of the fuel injector 10, such that there is enough fuel to inject at the intensified pressure during a single injection event.

According to the present disclosure, fuel may enter the fuel injector 110 at either an un-intensified pressure or an intensified pressure. When the nozzle outlets 170 of the fuel injector 110 are blocked, such that no fuel is being injected out of the fuel injector 110, the fuel injector 110 and the quill 50 are hydraulically balanced at about rail pressure if the intensifier piston 68 is in the un-intensified position, and at an intensified pressure if the intensifier piston 68 is in the intensified position.

Upon energizing the electrical actuator 61 of the quill 50 and the solenoid assembly 120 of the fuel injector 110, the nozzle outlets 170 of the fuel injector 110 become open. Fuel from the control chamber 70 moves to the drain port 65 and the intensifier piston 68 moves towards the second piston position. The movement of the intensifier piston 68 to the second piston position therefore reduces the volume of the pressurization chamber 80 and thereby, may increase the pressure of fuel inside the pressurization chamber 80, the fuel injector 110 and a portion of the passageway 53 that extends between the check valve 69 and the outlet port 56 of the quill 50 to an intensified pressure. Fuel may then leave the fuel injector with an injection pressure equivalent to the intensified pressure.

Those skilled in the art, however, will recognize that there are certain limits within which these dimensions may vary. For instance, the preload of the biasing spring 72 must be large enough, such that the biasing spring 72 may reset the intensifier piston 68 to the first piston position fast enough, so that the fuel injector 110 may perform a second intensified injection event with very little, if any delay between injection events. Further, the surface area of the small surface 81 may not be too small that the distance the intensifier piston 68 is too large that it cannot retract to the first piston position fast enough preventing the fuel injector from performing a second intensified injection event within the desired dwell. Additionally, factors including the incompressibility of the fuel will also determine the range of the surface area of the small surface 81 and length of the pressurization chamber 80.

INDUSTRIAL APPLICABILITY

The present disclosure relates generally to common rail fuel systems that include quills to supply fuel from a common rail to a fuel injector, and more particularly to an intensifier quill that is capable of supplying fuel from a common rail to a fuel injector at injection rates higher than the rail pressure as well as injection pressures about equal to rail pressure.

The present disclosure teaches an intensifier quill 50 that that may supply fuel to the fuel injector 110 at injection pressures about equal to the rail pressure when the quill 50 is in an un-intensified mode and at pressures greater than rail pressure when the quill 50 is in an intensified mode.

Referring to the Figures, a common rail fuel system 10 includes at least one fuel injector 110 that is fluidly connected to a common rail 12 that supplies fuel from a fuel tank 18 to the fuel injector 110 via a quill 50. An electronic controller 15 provides electronic control signals to the solenoid assembly 120 of the fuel injector 110 to initiate and end an injection event. The electronic controller 15 also provides electronic control signals to the electronic actuator 61 of the quill 50 to allow operators to inject fuel from the fuel injectors at injection pressures at or greater than rail pressure.

Before the electronic controller 15 initiates an injection event, the solenoid assembly 120 of the fuel injector 110 is de-energized. The armature assembly 115 is at the first armature position and the control valve member 132 is seated at the lower valve seat 134. The needle control chamber 150 is fluidly connected to the nozzle chamber 167 via the control valve 130, hence keeping the needle check valve 162 in the closed configuration, thereby blocking fuel from leaving the fuel injector 110. The rail inlet port 152 is fluidly connected to the quill 50, which is fluidly connected to the common rail 12. Because the fuel inside the fuel injector 110 has nowhere to go, there is very little, if any fluid movement inside the quill 50 and the fuel injector 110. The fluid pressure inside the fuel injector 110 and the quill 50 is maintained at about rail pressure.

In order to initiate an injection event, the electronic controller 15 energizes the solenoid assembly 115, causing the armature assembly 115 to move to the second armature position and the control valve member 132 to move to the upper valve seat 133. The needle control chamber 150 is now fluidly connected to drain 144, relieving pressure inside the needle control chamber 150 and thereby allowing the needle check valve 162 to move towards the open configuration. Once the nozzle outlet 170 is in the open configuration, fuel inside the fuel injector 110 and the quill 50 flows until the injection event is ended.

In order to improve combustion efficiency, people skilled in the art may recognize performing an injection event at higher injection pressures. According to the present disclosure, in order to achieve high injection pressures, the electronic controller 15 may initially energize the quill 50 while keeping the fuel injector 110 de-energized, until the pressure inside the fuel injector 110 is settled at the intensified injection pressure. Upon achieving the intensified injection pressure, the fuel injector 110 is energized to allow an intensified injection event at the intensified injection pressure to begin. The electronic controller 15 then ends the injection event by de-energizing the fuel injector 110. Finally, the electronic controller 15 de-energizes the quill 50, after which the quill 50 is reset to its un-intensified position, ready to perform a subsequent intensified, injection event.

There are four possible states that the electronic controller 15 may set the fuel injection system 10 in. The four states include State 1, where both the fuel injector 110 and the quill 50 are de-energized, State 2 where the fuel injector 110 is energized and the quill 50 is de-energized, State 3 where both the fuel injector 110 and the quill 50 are energized and State 4 where the fuel injector 110 is de-energized and the quill 50 is energized. In a typical injection event sequence, the electronic controller 15 may initiate an injection event starting with Stage 1, followed by State 2 and State 3. The injection event may end by de-energizing the fuel injector 110 after de-energizing the quill 50 (State 4), before de-energizing the quill 50 (State 3), or de-energizing both the fuel injector 110 and the quill 50 simultaneously (State 1).

In State 1, there is no activity as both the fuel injector 110 and the quill 50 are de-energized. Typically, the fuel injector 110 remains in Stage 1 in between injection events. The nozzle outlet 170 of the fuel injector 110 is closed and therefore, fuel inside the fuel injector 110 is at about the pressure at which fuel is entering the fuel injector 110 from the quill 50. Because the quill 50 is also de-energized and the control valve 60 of the quill 50 is in the second valve position, the control chamber 70 is fluidly connected to the common rail 12 allowing high-pressure fuel in the control chamber 70. The high-pressure fuel in the control chamber 70 along with the biasing force exerted by the biasing spring 72 exert a force on the control surface 71 combined with the fuel inside the pressurization chamber 80 exerts a force on the small surface 81 countering the force acting on the large surface 58 exerted by fuel inside the actuation chamber 57. Therefore, when the control valve 60 is in a de-energized state, the intensifier piston 68 either moves to or remains in the first piston position. Fuel in the control chamber 70, the pressurization chamber 80 and the passageway 53 is also at rail pressure and the check valve 69 remains open.

While the fuel system is in State 2, the fuel injector 110 performs an injection event at the un-intensified pressure. To perform an injection event at the un-intensified pressure, the quill 50 is de-energized while fuel injector 110 is energized. As long as the control valve 60 is de-energized, the quill 50 fluidly connects the fuel injector 110 and the common rail 12. Therefore, while the fuel injector 110 is energized and the nozzle outlets 170 are open, fuel from the common rail 12 will flow through the control valve 60 into the control chamber 70 through passageway 53 partially defined by the quill body 54, into the fuel injector 110 via rail inlet port 152 and out of the nozzle outlets 170 at rail pressure. The fuel from the common rail 12 will continue to flow to the fuel injector 110 until the fuel injector 110 is de-energized and fluid inside the fuel injector 110 is brought back to rail pressure. However, fuel stops to flow through the nozzle outlets 170 as soon as the nozzle outlets 170 are closed. If the fuel injector 110 is energized while the quill 50 is at the first piston position, the quill 50 may maintain the intensifier piston 68 at the first piston position.

In State 3, both the quill 50 and the fuel injector 110 are energized. Upon energizing the fuel injector 110, the nozzle outlets 170 are opened and fuel begins to leave the fuel injector 110 at the intensified injection pressure. Shortly thereafter, the injection pressure decreases and the intensifier piston 68 moves towards the second piston position from the third piston position. This is because the pressure of the fuel inside the pressurization chamber 80 decreases, thereby reducing the force exerted by the fuel on the small surface 81 of the intensifier piston 68. The force exerted on the large surface 58 of the intensifier piston 68 by fuel inside the actuation chamber 67 exceeds the net force acting on the control surface 71 and the small surface 81, allowing the intensifier piston 68 to move from the third piston position to the second piston position. The amount of fuel inside the fuel injector, the pressurization chamber and a portion of the passageway 53 is the total amount of fuel the fuel injector may inject until the quill 50 is de-energized. To end the injection event, the fuel injector 110 is de-energized again.

In State 4, the fuel injector 110 is de-energized and the quill 50 is energized. When the fuel injector 110 is de-energized, the quill 50 is hydraulically balanced and all the forces acting on the surfaces of the intensifier piston 68 are all at rail pressure. As the control valve 60 moves from the first valve position to the second valve position, the control valve 60 fluidly blocks the control chamber 70 from the common rail 12, but fluidly connects the control chamber 70 to the low-pressure drain passage 63. Fuel inside the control chamber 70 moves towards the drain passage 63, reducing the pressure inside the control chamber 70, thereby closing the check valve 69 thus preventing fuel from the pressurization chamber 80 and the fuel injector 110 from leaving the quill 50 via the drain passage 63. Because the pressure acting on the control surface 71 has now decreased, the intensifier piston moves towards the second piston position, until it settles at the third piston position where the forces acting on the respective surfaces of the intensifier piston 68 reach an equilibrium. By moving the intensifier piston 68 closer towards the second piston position, thereby reducing the volume of the pressurization chamber 80, the fluid pressure inside the pressurization chamber 80 and the fuel injector 110 increases to an intensified pressure. The intensified pressure is the highest pressure the fuel injector is capable of reaching under the present configuration.

De-energizing the solenoid assembly 120 of the fuel injector 110 ends the injection event. To prepare the quill 50 for a subsequent intensified injection event, the quill 50 may need to be reset by de-energizing the electrical actuator 61 of the quill 50. Upon de-energizing the electrical actuator 61, the control valve 60 moves to the first valve position, fluidly connecting the control chamber 70 to the common rail 12. The biasing spring 72 is at the second piston position and the spring 72 exerts a biasing force on the control surface 71 of the intensifier piston 68, causing the intensifier piston 68 to move towards the first piston position. As the biasing spring 72 retracts, the control chamber 70 and the pressurization chamber 80 become bigger. The fuel from the common rail 12 enters the control and pressurization chambers 70 and 80, exerting a force on the intensifier piston 68 that is larger than the force exerted on the large surface 58 of the intensifier piston 68 until the intensifier piston 68 reaches the retracted un-intensified position and the intensifier piston is hydraulically balanced. Nevertheless, the present disclosure also contemplates intensifier pistons that are not hydraulically balanced. The force of the biasing spring 72 keeps the intensifier piston 68 in the retracted position, until the control valve 60 is re-energized, and the fuel in the control chamber 70 moves to the drain passage 63. As the fuel leaves, reducing the force acting on the control surface 71, the intensifier piston 68 may begin to move towards the second piston position of the intensifier piston 68. Subsequent injection events may be repeated by going through the sequences described in States 1, 2, 3 and 4.

The present disclosure has the advantage of performing injection events having higher injection pressures than currently available. By performing injection events at higher pressures, fuel injectors may improve their combustion efficiency and reduce undesirable emissions, such as NOx. Further, the present disclosure allows operators to choose from a wider range of injection pressures, depending upon their desired needs.

Furthermore, the present disclosure provides operators to alter injection pressures at various times during an injection sequence, including during injection events. The present disclosure allows operators to perform injection events with different shapes, such as a boot shaped injection event, a ramp shaped injection event and a square shaped injection event. A boot shaped injection event may be performed by performing an injection event at rail pressure, and then energizing the electrical actuator 61 of the quill, thereby intensifying the injection pressures to an intensified pressure, some time after injection at rail pressure has commenced, thereafter the fuel injector 110 is de-energized, ending the injection event at high pressure. A ramp shaped injection event may be performed by energizing the solenoid assembly 120 of the fuel injector 110 and the electrical actuator 61 of the quill 50 close in time. Similarly, a square shaped injection event may be performed by energizing the electrical actuator 61 of the quill 50, then energizing the solenoid assembly 120 of the fuel injector 110, and then de-energizing the solenoid assembly 120 of the fuel injector 110 before de-energizing the electrical actuator 61 of the quill 50. Furthermore, injection events may be a combination of various rate shaping injection events. In one embodiment, an injection sequence may include a small pilot injection at rail pressure, followed by a main injection event that may take the shape of a ramp, a square or a boot shaped injection event, or any combination thereof, followed by a small post injection event at rail pressure to end the injection sequence.

In addition, with only slight, if any modifications to current engine designs, the present embodiment may be adapted to be used with current fuel injectors. This may allow predecessor machines to make minor adjustments, if any to the engine to include the intensifier quill, which may allow operators to improve combustion efficiency. Furthermore, one embodiment of the quill may be interchangeable with a predecessor quill of various machines according to the present disclosure. The present disclosure also allows engine manufacturers to manufacture engines that may include the conventional quill for jurisdictions with lower emissions standards, and engines that may include the intensifier quill for jurisdictions having more stringent emissions standards. Finally, engine manufacturers may upgrade engines by replacing the conventional quill of these engines with the intensifier quill with little, if any, modification to the predecessor engines.

It should be understood that the above description is intended for illustrative purposes only, and is not intended to limit the breadth of the present disclosure in any way. Thus, those skilled in the art will appreciate that various modifications might be made to the presently disclosed embodiments without departing from the full and fair scope of the present disclosure. Other aspects, features and advantages can be obtained from a study of the drawings, and the appended claims.

I claim:

1. An engine, comprising:
an engine head;
a fuel injector mounted in the engine head;
a quill partially positioned in the engine head, and having a first end receiving fuel from outside the engine head and a second end in seated contact with an inlet port of the fuel injector, and the quill including:
a quill body;
an intensifier piston slidably movable within the quill body; and
an electrical actuator coupled to a control valve.

2. The engine of claim 1 wherein the quill further includes:
a communication passage extending between a control chamber of the quill body and the control valve; and
a drain passage extending between the control valve and an outer surface of the quill.

3. The engine of claim 1 wherein the quill body defines an inlet port and an outlet port; and
a passageway, partially defined by the quill body, fluidly connecting the inlet port to the outlet port.

4. The engine of claim 1, wherein the fuel injector is clamped to the top of the engine head and the quill is clamped to the side of the engine head.

5. The engine of claim 1, wherein one of the quill and the fuel injector has a conical seat and the other of the quill and the fuel injector has a spherical end in contact with the conical seat.

6. The engine of claim 1 wherein the quill body further including an actuation chamber, a control chamber and a pressurization chamber disposed therein;
the intensifier piston includes a large surface, a control surface and a small surface exposed to fluid pressure, respectively inside the actuation chamber, the control chamber and the pressurization chamber; and
a check valve fluidly positioned between the control chamber and the pressurization chamber.

7. The engine of claim 6 wherein:
the control chamber is fluidly blocked to a drain passage when the control valve is in a first valve position;
the control chamber is fluidly connected to a drain passage when the control valve is in a second valve position.

8. The engine of claim 7 wherein:
the fuel injector is clamped to a top of the engine head and the quill is clamped to a side of the engine head; and
one of the quill and the fuel injector has a conical seat and the other of the quill and the fuel injector has a spherical end in contact with the conical seat.

9. A quill for a common rail fuel system, comprising:
a quill body defining an inlet port and an outlet port;
an electrical actuator coupled to a control valve fluidly connected to the quill body;
an intensifier piston slidably movable inside the quill body; and
a passageway, at least partially defined by the quill body, fluidly connecting the inlet port to the outlet port.

10. The quill of claim 9 further includes:
an actuation chamber, a control chamber and a pressurization chamber disposed in the quill body;
a communication passage extending between the control chamber of the quill body and the control valve; and
a drain passage extending between the control valve and an outer surface of the quill.

11. The quill of claim 9 wherein the quill body further includes a check valve positioned between the control chamber and the pressurization chamber.

12. The quill of claim 10 including a spring in contact with the control chamber;
the spring biasing the intensifier piston towards a first piston position.

13. The quill of claim 9 wherein:
the control chamber is fluidly blocked to a drain port when the control valve is in a first valve position;
the control chamber is fluidly connected to a drain port when the control valve is in a second valve position.

14. The quill of claim 9 further includes:
an actuation chamber, a control chamber and a pressurization chamber disposed in the quill body;
a communication passage extending between the control chamber of the quill body and the control valve;
a drain passage extending between the control valve and an outer surface of the quill;
a check valve positioned between the control chamber and the pressurization chamber;
a spring in contact with the control chamber;
the spring biasing the intensifier piston towards a first piston position;
the control chamber is fluidly blocked to the drain port when the control valve is in a first valve position; and
the control chamber is fluidly connected to the drain port when the control valve is in a second valve position.

15. A method of operating an engine including an engine head, a quill disposed within the engine head and in seated contact with a fuel injector, comprising the steps of:
injecting fuel from a fuel injector at an intensified pressure by moving an intensifier piston of the quill;
injecting fuel from the fuel injector at an un-intensified pressure by moving common rail fuel into the fuel injector from a common rail through the quill.

16. The method of operating an engine of claim 15, wherein the step of injecting fuel from a fuel injector at an intensified pressure includes the steps of:
moving the intensifier piston from a first piston position to a second piston position; and
moving fuel from the quill to a drain port.

17. The method of operating an engine of claim 15, wherein the step of injecting fuel from a fuel injector at an intensified pressure includes the steps of:
moving the intensifier piston from a first piston position to a second piston position;
moving fuel inside a control chamber to a drain port; and moving fuel from a pressurization chamber to the fuel injector.

18. The method of operating an engine of claim 17 further includes a step of closing a check valve between the pressurization chamber and the control chamber.

19. The method of operating an engine of claim 15, wherein the step of injecting fuel from a fuel injector at an un-intensified pressure includes the steps of:

opening a check valve between a control chamber and a pressurization chamber of the quill;

moving fuel from the control chamber to the fuel injector.

20. The method of operating an engine of claim 19, wherein the step of injecting fuel from a fuel injector at an un-intensified pressure includes maintaining the intensifier piston at a first piston position.

* * * * *